US011393426B2

(12) United States Patent
Shan

(10) Patent No.: US 11,393,426 B2
(45) Date of Patent: Jul. 19, 2022

(54) DISPLAY AND DRIVING DEVICE FOR DRIVING HIGH AND LOW VOLTAGE DATA TO ADJACENT PIXELS AND METHOD THEREOF

(71) Applicant: HKC CORPORATION LIMITED, Guangdong (CN)

(72) Inventor: Jianfeng Shan, Guangdong (CN)

(73) Assignee: HKC CORPORATION LIMITED, Guangdong (CN)

( * ) Notice: Subject to any disclaimer, the term of this patent is extended or adjusted under 35 U.S.C. 154(b) by 0 days.

(21) Appl. No.: 17/270,866

(22) PCT Filed: Dec. 12, 2019

(86) PCT No.: PCT/CN2019/124875

§ 371 (c)(1),
(2) Date: Feb. 24, 2021

(87) PCT Pub. No.: WO2020/135075

PCT Pub. Date: Jul. 2, 2020

(65) Prior Publication Data

US 2021/0201841 A1 Jul. 1, 2021

(30) Foreign Application Priority Data

Dec. 26, 2018 (CN) ..... 201811608395.8

(51) Int. Cl.
*G09G 3/36* (2006.01)

(52) U.S. Cl.
CPC ..... *G09G 3/3696* (2013.01); *G09G 3/3607* (2013.01)

(58) Field of Classification Search
CPC ..... G09G 3/3696
(Continued)

(56) References Cited

U.S. PATENT DOCUMENTS 6,504,523 B1 1/2003 Sugawara et al.
2016/0097943 A1 4/2016 Mimura et al.
(Continued)

FOREIGN PATENT DOCUMENTS

CN 1699967 A 11/2005
CN 101271207 A 9/2008
(Continued)

OTHER PUBLICATIONS

First Office Action in counterpart Chinese Application No. 201811608395.8, dated Jan. 17, 2020.
(Continued)

*Primary Examiner* — Long D Pham

(57) ABSTRACT

A display and a driving device and method for display panel thereof are provided. The driving method comprises: determining corresponding first high voltage data according to first initial driving data of a first target pixel, and determining corresponding first low voltage data according to second initial driving data of a second target pixel; determining first target high voltage driving data according to the first high voltage data, and determining first target low voltage driving data according to the first low voltage data; and driving the first target pixel with the first target high voltage driving data, and driving the second target pixel with the first target low voltage driving data.

16 Claims, 4 Drawing Sheets

(58) Field of Classification Search
USPC ..... 345/87
See application file for complete search history.

(56) References Cited

U.S. PATENT DOCUMENTS

| | | | | |
|---|---|---|---|---|
| 2016/0140920 | A1* | 5/2016 | Lee | G09G 3/3655 345/209 |
| 2016/0379576 | A1 | 12/2016 | Shin | |
| 2018/0114478 | A1* | 4/2018 | Tien | G09G 3/3614 |
| 2020/0184913 | A1* | 6/2020 | Huang | G09G 3/3614 |

FOREIGN PATENT DOCUMENTS

| | | | |
|---|---|---|---|
| CN | 105895040 | A | 8/2016 |
| CN | 107301851 | A | 10/2017 |
| CN | 107833561 | A | 3/2018 |
| CN | 107886923 | A | 4/2018 |
| CN | 108107634 | A | 6/2018 |
| CN | 108109599 | A | 6/2018 |
| CN | 108320716 | A | 7/2018 |
| CN | 108766372 | A | 11/2018 |
| CN | 108831405 | A | 11/2018 |
| CN | 109509456 | A | 3/2019 |
| KR | 20150049630 | A | 5/2015 |
| WO | 2017201811 | A1 | 11/2017 |

OTHER PUBLICATIONS

International Search Report in corresponding PCT Application No. PCT/CN2019/124875, dated Mar. 12, 2020 and Written Opinion of the International Searching Authority in corresponding PCT Application No. PCT/CN2019/124875, dated Mar. 12, 2020.

* cited by examiner

DISPLAY AND DRIVING DEVICE FOR DRIVING HIGH AND LOW VOLTAGE DATA TO ADJACENT PIXELS AND METHOD THEREOF

CROSS REFERENCE TO RELATED APPLICATION

The present application is the national stage of International Application with No. PCT/CN2019/124875, filed Dec. 12, 2019, which claims priority to Chinese Patent Application No. 201811608395.8, filed on Dec. 26, 2018, and entitled "DISPLAY PANEL DRIVING METHOD, DEVICE and READABLE STORAGE MEDIUM", the entire content of which is hereby incorporated by reference.

TECHNICAL FIELD

The present application relates to the technical field of display, in particular to a driving method for display panel, a driving device for display panel and a display.

BACKGROUND

The statement herein only provides background information related to the present application and does not necessarily constitute the prior art.

Large-size liquid crystal display panels mostly adopt negative VA (Vertical Alignment) liquid crystal technology or IPS (In-Panel Switching) liquid crystal technology. Compared with IPS liquid crystal technology, VA liquid crystal technology has advantages of higher production efficiency and lower manufacturing cost, but it has obvious defects in optical properties. For example, when large-size display panels need to be presented at a larger viewing angle, VA liquid crystal display panels generally have a color shift phenomenon.

At present, the way to ameliorate color shift is to give different driving voltages in time sequence to a same sub-pixel or give different driving voltages to adjacent sub-pixels in the display array. However, considering that a same transmission data line is used to drive a same column of sub-pixels, there exists a capacitance-resistance effect between the transmission data line and other electrodes of the pixels. Thus if the transmission data line frequently switches between high and low voltages, the capacitance-resistance effect will distort the high and low voltage signals and affect the display quality of pictures.

SUMMARY

The main objective of the present application is to provide a driving method for display panel, aiming at improving the display quality of pictures.

In order to achieve the above objective, the present application provides a driving method for display panel. The display panel includes a plurality of pixel groups arranged in an array, each of the pixel groups including a first pixel unit, the first pixel unit including at least two first sub-pixels; a first sub-pixel in one of any two adjacent pixel groups is defined as a first target pixel and a first sub-pixel in the other of the two adjacent pixel groups is defined as a second target pixel; the driving method of the display panel includes the following steps:

acquiring first initial driving data corresponding to a first target pixel, acquiring second initial driving data corresponding to a second target pixel;

determining corresponding first high voltage data according to the first initial driving data, and determining corresponding first low voltage data according to the second initial driving data;

determining first target high voltage driving data corresponding to the first target pixel according to the first high voltage data, and determining first target low voltage driving data corresponding to the second target pixel according to the first low voltage data; and driving the first target pixel with the first target high voltage driving data, and driving the second target pixel with the first target low voltage driving data.

According to the driving method for display panel of the embodiments of the present application, in the display array of the display panel, a combination of at least two sub-pixels forms a pixel unit, adjacent pixel units are driven by a target high voltage driving data larger than a initial driving data and a target low voltage driving data smaller than a initial driving data respectively. When a row or a column in which the at least two sub-pixels are located is driven using the same data line, since the sub-pixels in a pixel unit are all of high voltage or low voltage, the high and low voltages on the data line do not need to be frequently switched in units of sub-pixels, but are switched in units of pixel units. Therefore, it is beneficial to lighten the color shift while avoid signal distortion caused by capacitance-resistance effect and improve the display quality of pictures.

Figure 1:
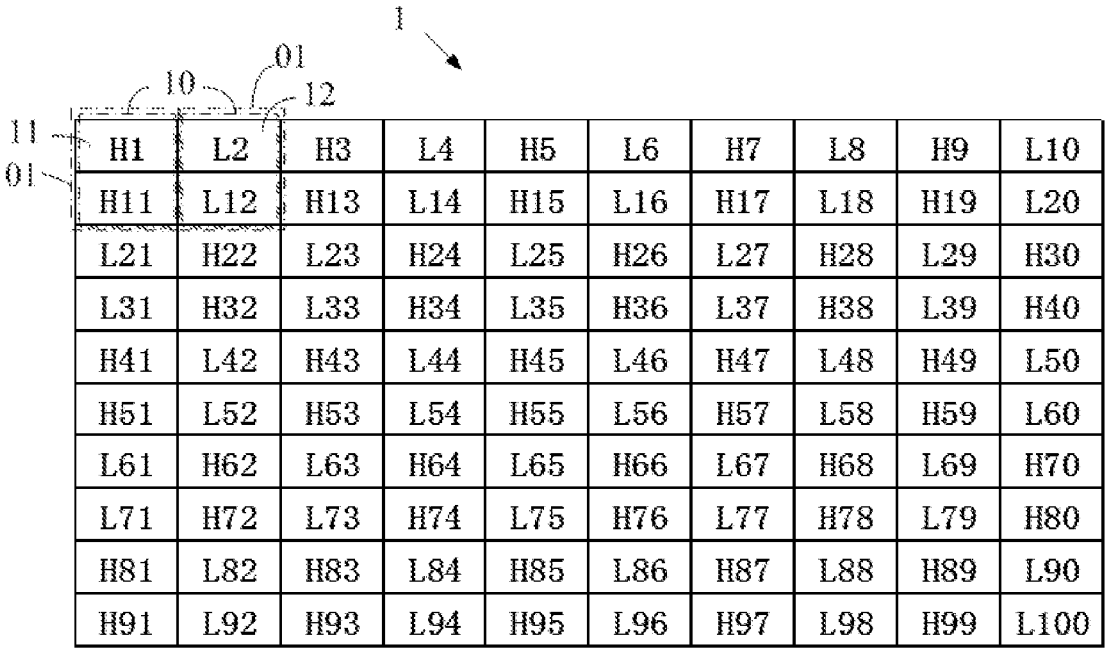
FIG. 1 is a schematic diagram show distribution of driving voltage of each sub-pixel for display array of a first embodiment related in a driving method for display panel of the present application.

The realization of purpose, functional features and advantages of the present application will be further described in connection with embodiments and with reference to the accompanying drawings.

DETAILED DESCRIPTION OF THE EMBODIMENTS

It should be understood that the specific embodiments described herein are intended to explain the application only and are not intended to limit the application.

That main solution of the embodiments of the present application is that, in a display panel, the display panel includes a plurality of pixel groups 01 arranged in an array, each of the pixel groups 01 including a first pixel unit, the first pixel unit including at least two first sub-pixels; a first sub-pixel in one of any two adjacent pixel groups 01 being defined as a first target pixel 11 and a first sub-pixel in the other of any two adjacent pixel groups 01 being defined as a second target pixel 12. Based on the above settings, a driving method for display panel includes the following steps: acquiring first initial driving data corresponding to the first target pixel 11 and acquiring second initial driving data corresponding to the second target pixel 12; determining first high voltage data corresponding to the first initial driving data, and determining first low voltage data corresponding to the second initial driving data; determining first target high voltage driving data corresponding to the first target pixel 11 according to the first high voltage data, and determining first target low voltage driving data corresponding to the second target pixel 12 according to the first low voltage data; and driving the first target pixel 11 with the first target high voltage driving data, and driving the second target pixel 12 with the first target low voltage driving data. Since a same transmission data line is used to drive a same column of sub-pixels, and there exists a capacitance-resistance effect between the transmission data line and other electrodes of pixels, the capacitance-resistance effect will distort high and low voltage signals and affect a display quality of pictures if the transmission data line frequently switches between the high and low voltages. The present application provides a solution, which is beneficial to avoid signal distortion caused by the capacitance-resistance effect and improve the display quality of pictures.

An embodiment of the present application provides a driving method for display panel, which is applied to drive a display panel. The display panel can specifically include a liquid crystal display panel, in particular a TN (twisted nematic) liquid crystal display panel, an OCB (optically compensated birefringence) liquid crystal display panel, a VA type liquid crystal display panel, or the like. The display panel includes pixel groups 01 arranged in an array. The pixel groups 01 include a first pixel unit 10, and the first pixel unit 10 includes at least two first sub-pixels. Each first sub-pixel in one of each two adjacent pixel groups 01 is defined as a first target pixel 11, and each first sub-pixel in the other of the two adjacent pixel groups 01 is defined as a second target pixel 12.

In a display array 1 of the liquid crystal display panel, a plurality of sub-pixels are arranged in an array, and each sub-pixel is connected to a gate data line and a source data line. The sub-pixels of a row are connected to a same gate data line and the sub-pixels of a column are connected to a same source data line. The sub-pixels of each row receive a gate driving signal input by a gate driver through the gate data line to control thin film transistors of the sub-pixels to be turned on or off. When a thin film transistor is turned on, a sub-pixel receives a source driving signal input by the source driver through the source data line. A voltage difference between the source driving signal and a common voltage charges a capacitor, and the voltage cross the capacitor deflects the liquid crystal molecules in the capacitor, so that an amount of light from a backlight corresponding to a deflection degree of the liquid crystal molecules is transmitted by the liquid crystal molecules, thus presenting the sub-pixel at a corresponding brightness.

Based on the above settings, referring to FIG. 1, the display array 1 of the display panel of the present embodiment includes the pixel groups 01. Each pixel group 01 includes a first pixel unit 10, and the pixel groups 01 arranged in an array form the display array 1 of the display panel. Specifically, since at the current sub-pixels of a same column are generally driven by a same source data line, the first pixel unit 10 can include at least two first sub-pixels arranged along a column direction. The first sub-pixel may specifically be a red sub-pixel, a green sub-pixel, a blue sub-pixel, or the like.

Figure 2:
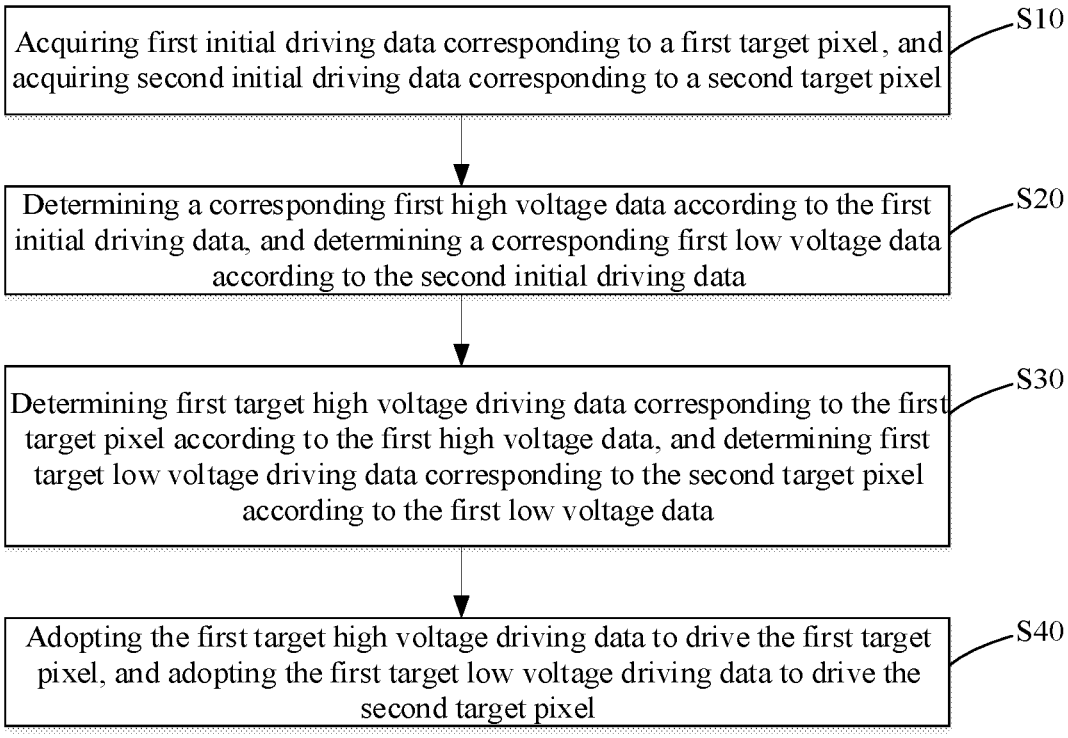
FIG. 2 is a flow diagram of the driving method for display panel according to a first embodiment of the present application.

Referring to FIG. 2, a driving method for display panel includes the following steps:

Step S10, acquiring first initial driving data corresponding to a first target pixel, and acquiring second initial driving data corresponding to a second target pixel.

The first initial driving data is a preset driving voltage determined according to a gray scale to be displayed by the first target pixel. Different gray scales are correspondingly set with different preset driving voltages. Specifically, the gray scale corresponding to each first target pixel in image data of a current image frame can be obtained, and the corresponding first initial driving data can be determined according to the gray scale of each first target pixel.

The second initial driving data is a preset driving voltage determined according to a gray scale to be displayed by the second target pixel. Different gray scales are correspondingly set with different preset driving voltages. Specifically, the gray scale corresponding to each second target pixel in the image data of the current image frame can be obtained, and the corresponding second initial driving data can be determined according to the gray scale of each second target pixel.

Step S20, determining a corresponding first high voltage data according to the first initial driving data, and determining a corresponding first low voltage data according to the second initial driving data.

The first high voltage data of each first target pixel 11 is greater than the first initial driving data corresponding to the first target pixel 11, and the first low voltage data of the second target pixel 12 is less than the second initial driving data corresponding to the second target pixel 12.

Specifically, the first initial driving data can be increased by a preset voltage to obtain the first high voltage data, and the second initial driving data can be decreased by a preset voltage to obtain the first low voltage data. Here, the preset voltage increased corresponding to the first initial driving data can be defined as a first preset amplitude, and the preset voltage decreased corresponding to the second initial driving data can be defined as a second preset amplitude. The preset voltage increased and the preset voltage decreased can be determined according to a specific gray scale of each first sub-pixel. The first sub-pixels of different gray scales may correspond to different preset voltages increased and different preset voltages decreased. Therefore, a first preset amplitude of a first sub-pixel which is taken as the first target pixel can be determined according to the gray scale of the first target pixel, and a second preset amplitude of a first sub-pixel which is taken as the second target pixel can be determined according to the gray scale of the second target pixel.

Step S30, determining first target high voltage driving data corresponding to the first target pixel 11 according to the first high voltage data, and determining first target low voltage driving data corresponding to the second target pixel 12 according to the first low voltage data.

Two adjacent first pixel units 10 are defined to include a first unit and a second unit, each of the first sub-pixels in the first unit being the first target pixel 11 and each of the first sub-pixels in the second unit being the second target pixel 12.

The first target high voltage driving data is the driving voltage of the first target pixel 11, and each first target pixel has a corresponding first target high voltage driving data. The first target low voltage driving data is the driving voltage of the second target pixel 12, and each second target pixel has a corresponding first target low voltage driving data.

The first target high voltage driving data corresponding to each first target pixel 11 can be determined according to the first high voltage data corresponding to the first target pixel 11. The first high voltage data can be directly taken as the first target high voltage driving data to drive the first target pixel 11, or the first target high voltage driving data can be calculated according to the first high voltage data and a compensation voltage, and the obtained first target high voltage driving data is used to drive the first target pixel 11. The first target low voltage driving data corresponding to each second target pixel 12 can be determined based on the first low voltage data corresponding to the second target pixel 12. The first low voltage data can be directly taken as the first target low voltage driving data to drive the second target pixel 12, or the first target low voltage driving data can be calculated according to the first low voltage data and a compensation voltage, and the obtained first target low voltage driving data is used to drive the second target pixel 12.

Step S40, adopting the first target high voltage driving data to drive the first target pixel 11, and adopting the first target low voltage driving data to drive the second target pixel 12.

A schematic diagram of a driving voltage distribution of the sub-pixels in the display array 1 can make reference to FIG. 1.

According to the driving method for display panel of the embodiments of the present application, in the display array of the display panel, a combination of at least two sub-pixels forms a pixel unit, adjacent pixel units are driven by a target high voltage driving data larger than the initial driving data and a target low voltage driving data smaller than the initial driving data respectively. When a row or a column in which the at least two sub-pixels are located is driven using the same data line, since the sub-pixels in a pixel unit are all of high voltage or low voltage, the high and low voltages on the data line do not need to be frequently switched in units of sub-pixels, but are switched in units of pixel units. Therefore, it is beneficial to lighten the color shift while avoid signal distortion caused by capacitance-resistance effect and improve the display quality of pictures.

Figure 3:
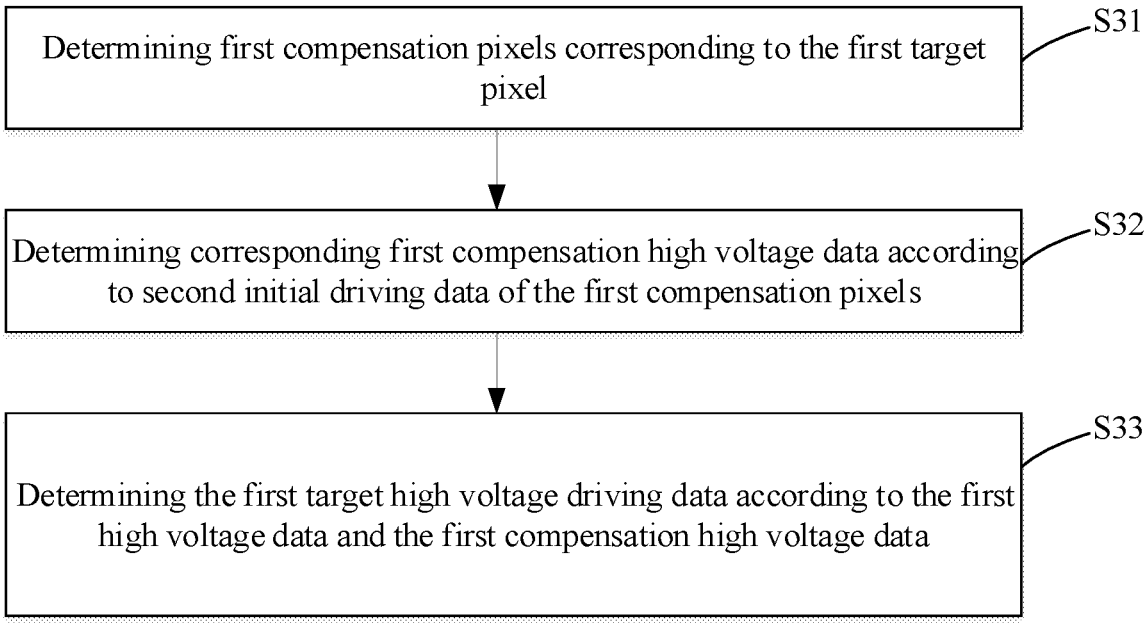
FIG. 3 is a flow diagram of the driving method for display panel according to a second embodiment of the present application.

Further, referring to FIG. 3, defining a second target pixel 12 adjacent to the first target pixel 11 as a first compensation pixel, the step of determining first target high voltage driving data corresponding to the first target pixel 11 according to the first high voltage data includes:

Step S31, determining first compensation pixels corresponding to the first target pixel 11.

All the first compensation pixels (such as the sub-pixel corresponding to L33, the sub-pixel corresponding to L44 and the sub-pixel corresponding to L35 in FIG. 1) adjacent to the first target pixel 11 (such as the sub-pixel corresponding to H34 in FIG. 1) are determined.

Step S32, determining corresponding first compensation high voltage data according to second initial driving data of the first compensation pixels.

Since each second target pixel 12 has corresponding second initial driving data, the first compensation high voltage data corresponding to each first compensation pixel can be determined based on the second initial driving data. The first compensation high voltage data of each first compensation pixel is greater than the second initial driving data corresponding to the first compensation pixel. Specifically, the second initial driving data can be increased by a preset voltage corresponding to the sub-pixel to obtain the first compensation high voltage data. The preset voltage increased corresponding to the first compensation pixel can be defined as a third preset amplitude.

Step S33, determining the first target high voltage driving data according to the first high voltage data and the first compensation high voltage data.

Each first compensation pixel corresponds to first compensation high voltage data. The first target high voltage driving data can be obtained according to the first high voltage data of the first target pixel 11 and the first compensation high voltage data of the first compensation pixels. Specifically, a sum of the first high voltage data of the first target pixel 11 and the first compensation high voltage data corresponding to all the first compensation pixels adjacent to the first target pixel 11 can be taken as the first target high voltage driving data, or, a sum of the first high voltage data of the first target pixel 11 and the first compensation high voltage data corresponding to part of the first compensation pixels adjacent to the first target pixel 11 can be taken as the first target high voltage driving data. Since the second target pixel 12 itself displays the first target low voltage data, part or all of the first compensation high voltage data originally to be displayed by the second target pixels 12 adjacent to the first target pixel 11 are re-assigned to the first target pixel 11 as the compensation voltage of the first target pixel 11, the first target high voltage driving data displayed by the first target pixel 11 has characteristics to be displayed by its own first high voltage data and the first compensation high voltage data from its adjacent second target pixels 12, thereby lightening color shift while ensuring a resolution of the picture.

In addition, in order to further improve the resolution of the picture, step S33 can include:

Step S331, acquiring a first preset weight corresponding to the first compensation pixel.

According to different resolution requirements, different first compensation pixels are correspondingly set with same or different first preset weights. Specifically, a resolution of a current picture can be obtained, and a value of the first preset weight corresponding to each first compensation pixel can be determined according to the obtained resolution.

Step S322, determining the first target high voltage driving data according to the first high voltage data, the first compensation high voltage data and the first preset weight.

The first compensation high voltage data of each of the first compensation pixels adjacent to the first target pixel 11 is assigned to the first target pixel 11 by weights, the first target high voltage driving data corresponding to the first target pixel 11 is calculated according to the first compensation high voltage data assigned to the first target pixel 11 and the first high voltage data of the first target pixel 11.

Taking determining the first target high voltage data of the sub-pixel corresponding to H34 as an example, the first high voltage data of the sub-pixel corresponding to H34 is H'34, the first compensation pixels of the sub-pixel corresponding to H34 are the sub-pixels respectively corresponding to L33, L44, and L35. If the first compensation high voltage data of the sub-pixel corresponding to L33 is H33, the first compensation high voltage data of the sub-pixel corresponding to L44 is H44, the first compensation high voltage data of the sub-pixel corresponding to L35 is H35, and the first preset weight corresponding to each of the first compensation pixels is ⅓, then H34=(H34+⅓*(H33+H44+H35))/2.

Through the above method, a presenting effect achieved by driving the first target pixel 11 with the first target high voltage is equivalent to a displaying effect achieved by driving each sub-pixel with the initial driving data (the first initial driving data and the second initial driving data), thereby ensuring the resolution of picture while ensuring view angle compensation.

Figure 4:
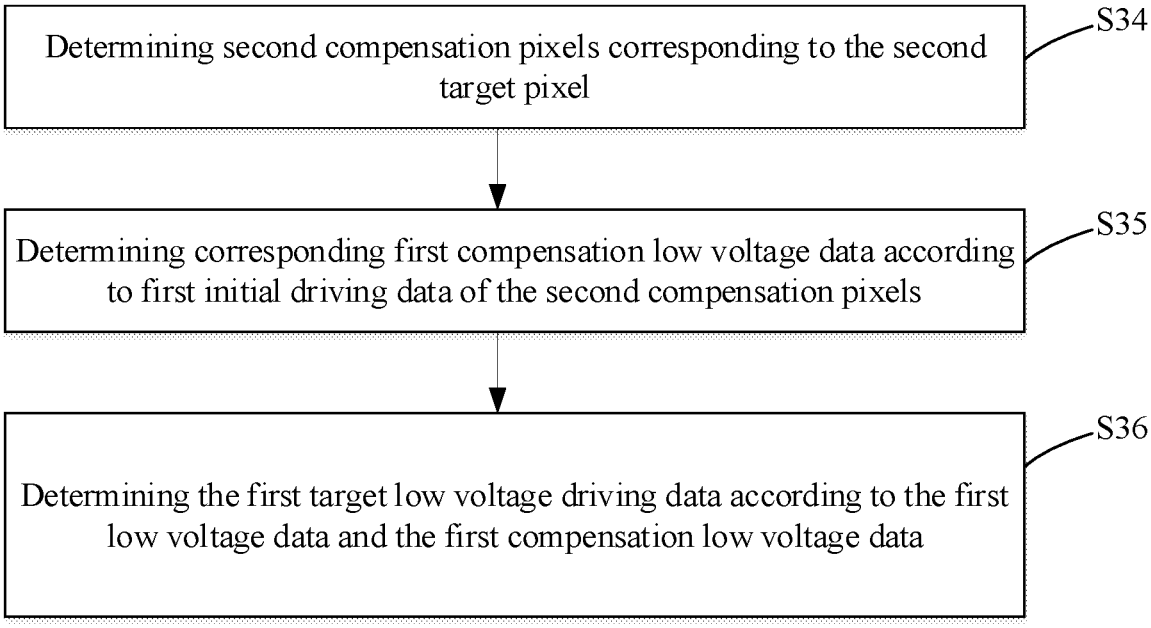
FIG. 4 is a flow diagram of the driving method for display panel according to a third embodiment of the present application.

Further, referring to FIG. 4, defining a first target pixel 11 adjacent to the second target pixel 12 as a second compensation pixel, the step of determining first target low voltage driving data corresponding to the second target pixel 12 according to the first low voltage data includes:

Step S34, determining second compensation pixels corresponding to the second target pixel 12.

All second compensation pixels (such as the sub-pixel corresponding to H43, the sub-pixel corresponding to H34 and the sub-pixel corresponding to H45 in FIG. 1) adjacent to the second target pixel 12 (such as the sub-pixel corresponding to L44 in FIG. 1) are determined.

Step S35, determining corresponding first compensation low voltage data according to first initial driving data of the second compensation pixels.

Since each of the first target pixels 11 has corresponding first initial driving data, the first compensation low voltage data corresponding to each of the second compensation pixels can be determined based on the first initial driving data. The first compensation low voltage data of each second compensation pixel is less than the first initial driving data corresponding to the second compensation pixel. Specifically, the first initial driving data can be decreased a preset voltage corresponding to the sub-pixel to obtain the first compensation low voltage data. The preset voltage decreased corresponding to the second compensation pixel can be defined as a fourth preset amplitude.

Step S36, determining the first target low voltage driving data according to the first low voltage data and the first compensation low voltage data.

Each second compensation pixel corresponds to first compensation low voltage data. The first target low voltage driving data can be obtained according to the first low voltage data of the second target pixel 12 and the first compensation low voltage data of the second compensation pixels. Specifically, a sum of the first low voltage data of the second target pixel 12 and the first compensation low voltage data corresponding to all the second compensation pixels adjacent to the second target pixel 12 can be taken as the first target low voltage driving data, or a sum of the first low voltage data of the second target pixel 12 and the first compensation low voltage data corresponding to part of the second compensation pixels adjacent to the second target pixel 12 can be taken as the first target low voltage driving data. Since the first target pixel 11 itself displays the first target high voltage data, part or all of the first compensation low voltage data which should be displayed by the first target pixels 11 adjacent to the second target pixel 12 are re-assigned to the second target pixel 12 as the compensation voltage of the second target pixel 12, the first target low voltage driving data displayed by the second target pixel 12 has characteristics to be displayed by its own first low voltage data and the first compensation low voltage data from its adjacent second target pixels 12, thereby lightening color shift while ensuring the resolution of the picture.

Among them, the steps S31, S32, S33, S34, S35 and S36 are simultaneously executed, and the first target pixel 11 is compensated by the first compensation high voltage data and the second target pixel 12 is compensated by the first compensation low voltage data, which is beneficial to improve the overall resolution of the displayed picture and make the displayed picture present a complete image quality.

In addition, in order to further improve the resolution of the picture, step S36 can include:

Step S361, acquiring second preset weights corresponding to the second compensation pixels.

According to different resolution requirements, different second compensation pixels are correspondingly set with a same second preset weight or with different second preset weights. Specifically, the resolution of the current displayed picture can be obtained, and a value of the second preset weight corresponding to each second compensation pixel can be determined according to the obtained resolution.

Step S362, determining the first target low voltage driving data according to the first low voltage data, the first compensation low voltage data and the second preset weights.

The first compensation low voltage data of each of the second compensation pixels adjacent to the second target pixel 12 is re-assigned to the second target pixel 12 according to the corresponding second preset weight. The first target low voltage driving data corresponding to the second target pixel 12 is calculated according to the first compensation low voltage data re-assigned to the second target pixel 12 and the first low voltage data of the second target pixel 12.

Taking determining the first target low voltage data L44 of the sub-pixel corresponding to L44 as an example, the first low voltage data of the sub-pixel corresponding to L44 is L'44, the first compensation pixels of the sub-pixel corresponding to L44 is the sub-pixels respectively corresponding to H43, H34, and H45, the first compensation low voltage data of the sub-pixel corresponding to H43 is L43, the first compensation low voltage data of the sub-pixel corresponding to H34 is L34, and the first compensation low voltage data of the sub-pixel corresponding to H45 is L45, and the second preset weight corresponding to each second compensation pixel is ⅓, then the first target low voltage data L44=(L44+⅓*(L43+L34+L45))/2.

Through the above method, a presenting effect achieved by driving the second target pixel 12 with the first target low voltage is equivalent to a displaying effect achieved by driving each sub-pixel with the initial driving data (the first initial driving data and the second initial driving data), thereby ensuring the resolution of picture while ensuring view angle compensation.

Figure 5:
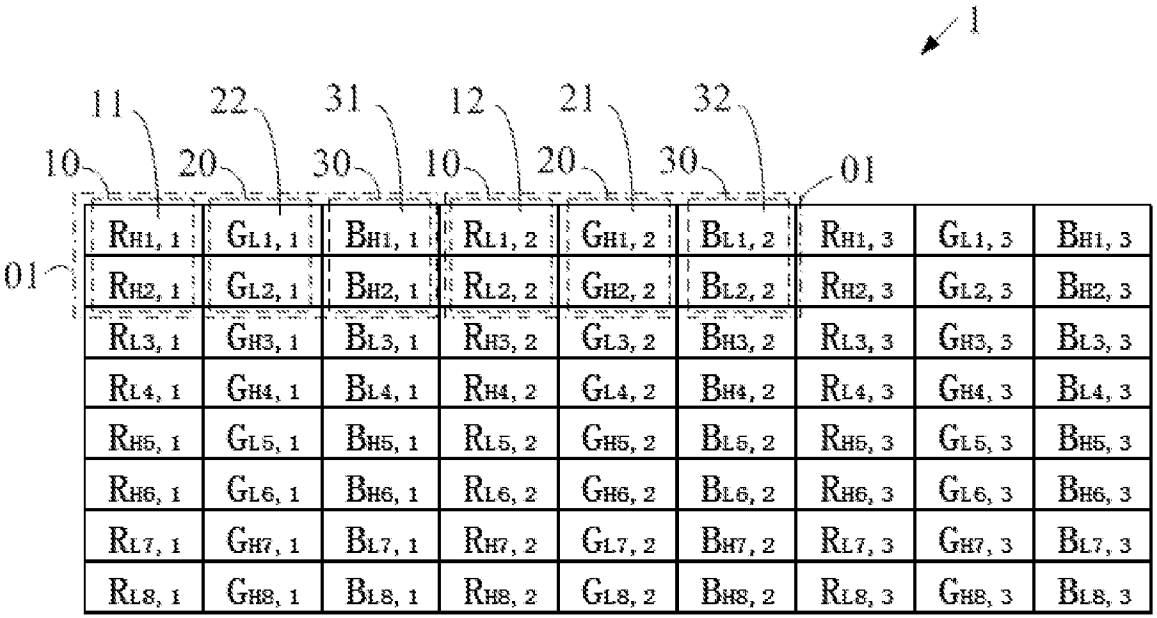
FIG. 5 is a schematic diagram showing a distribution of driving voltages of each sub-pixel of the display array of a second embodiment related in the driving method for display panel of the present application.

Further, referring to FIG. 5, each pixel group 01 further includes a second pixel unit 20 and a third pixel unit 30, the second pixel unit 20 including at least two second sub-pixels, the third pixel unit 30 including at least two third sub-pixels. The first pixel unit 10, the second pixel unit 20 and the third pixel unit 30 in each pixel group 01 are sequentially arranged along a row direction. Each second sub-pixel in one of any two adjacent pixel groups 01 is defined as a third target pixel 21 and each second sub-pixel in the other of the two adjacent pixel groups 01 is defined as a fourth target pixel 22. Each third sub-pixel in one of any two adjacent pixel groups 01 is defined as a fifth target pixel 31, and each third sub-pixel in the other of the two adjacent pixel groups 01 is defined as the sixth target pixel 32.

The pixel group 01 includes the second pixel unit 20 and the third pixel unit 30 in addition to the first pixel unit 10. In one pixel group 01, that first pixel unit 10, the second pixel unit 20 and the third pixel unit 30 are sequentially arrange in the row direction. A plurality of pixel groups 01 composed of the first pixel unit 10, the second pixel unit 20, and the third pixel unit 30 are arranged in an array to form the display array 1. In particular, since currently sub-pixels of a same column are generally driven by a same source data line, the second pixel unit 20 can include at least two second sub-pixels arranged in the column direction and the third pixel unit 30 can includes at least two third sub-pixels arranged in the column direction. The first sub-pixel, the second sub-pixel and the third sub-pixel can be a red sub-pixel, a green sub-pixel, a blue sub-pixel, or the like respectively, so as to realize multi-color display of the picture.

Figure 6:
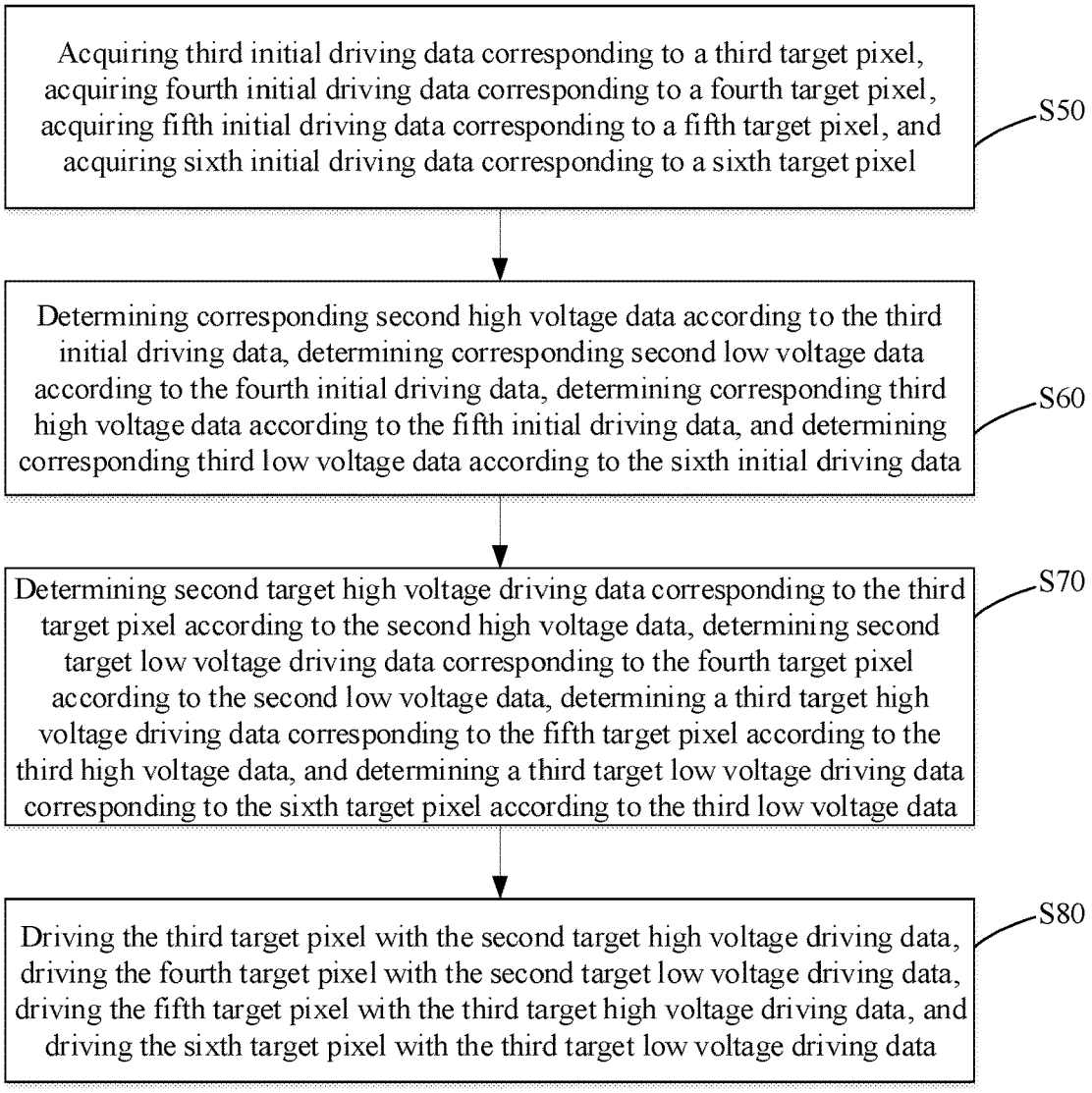
FIG. 6 is a flow diagram of the driving method for display panel according to a fourth embodiment of the present application.

Referring to FIG. 6, the driving method of the display panel further includes the following steps:

Step S50, acquiring third initial driving data corresponding to a third target pixel 21, acquiring fourth initial driving data corresponding to a fourth target pixel 22, acquiring fifth initial driving data corresponding to a fifth target pixel 31, and acquiring sixth initial driving data corresponding to a sixth target pixel 32;

Step S60, determining corresponding second high voltage data according to the third initial driving data, determining corresponding second low voltage data according to the fourth initial driving data, determining corresponding third high voltage data according to the fifth initial driving data, and determining corresponding third low voltage data according to the sixth initial driving data;

Step S70, determining second target high voltage driving data corresponding to the third target pixel 21 according to the second high voltage data, determining second target low voltage driving data corresponding to the fourth target pixel 22 according to the second low voltage data, determining a third target high voltage driving data corresponding to the fifth target pixel 31 according to the third high voltage data, and determining a third target low voltage driving data corresponding to the sixth target pixel 32 according to the third low voltage data;

Step S80, driving the third target pixel 21 with the second target high voltage driving data, driving the fourth target pixel 22 with the second target low voltage driving data, driving the fifth target pixel 31 with the third target high voltage driving data, and driving the sixth target pixel 32 with the third target low voltage driving data.

Defining a fourth target pixel 22 adjacent to a third target pixel 21 as a third compensation pixel, the step of determining second target high voltage driving data corresponding to the third target pixel 21 according to the second high voltage data includes: determining third compensation pixels corresponding to the third target pixel 21; determining corresponding second compensation high voltage data according to fourth initial driving data of the third compensation pixels; and determining the second target high voltage driving data based on the second high voltage data and the second compensation high voltage data. Defining a third target pixel 21 adjacent to the fourth target pixel 22 as a fourth compensation pixel, the step of determining second target low voltage driving data corresponding to the fourth target pixel 22 according to the second low voltage data includes: determining fourth compensation pixels corresponding to the fourth target pixel 22; determining corresponding second compensation low voltage data according to third initial driving data of the fourth compensation pixels; and determining the second target low voltage driving data based on the second low voltage data and the second compensation low voltage data. Defining a sixth target pixel 32 adjacent to the fifth target pixel 31 as a fifth compensation pixel, the step of determining third target high voltage driving data corresponding to the fifth target pixel 31 according to the third high voltage data includes: determining fifth compensation pixels corresponding to the fifth target pixel 31; determining corresponding third compensation high voltage data according to sixth initial driving data of the fifth compensation pixels; and determining the third target high voltage driving data based on the third high voltage data and the third compensation high voltage data. Defining a fifth target pixel 31 adjacent to the sixth target pixel 32 as a sixth compensation pixel, the step of determining third target low voltage driving data corresponding to the sixth target pixel 32 according to the third low voltage data includes: determining sixth compensation pixels corresponding to the sixth target pixel 32; determining corresponding third compensation low voltage data according to fifth initial driving data of the sixth compensation pixels; and determining the third target low voltage driving data based on the third low voltage data and the third compensation low voltage data.

The determination of second target high voltage driving data corresponding to the third target pixel 21 in the second pixel unit 20, and the determination of third target high voltage driving data corresponding to the fifth target pixel 31 in the third pixel unit 30 can make reference to the determination of the first target high voltage driving data corresponding to the first target pixel 11 in the first pixel unit 10 in the above embodiments, and will not be described here. The determination of second target low voltage driving data corresponding to the fourth target pixel 22 in the second pixel unit 20, and the determination of third target low voltage driving data corresponding to the sixth target pixel 32 in the third pixel unit 30 can make reference to the determination of the first target low voltage driving data corresponding to the second target pixel 12 in the first pixel unit 10 in the above embodiments, and will not be described here.

In this embodiment, the second pixel unit 20 and the third pixel unit 30 respectively drive the second sub-pixel and the third sub-pixel in a same driving mode as the first pixel unit 10, thus lightening the color shift of three-color display panels while avoiding signal distortion caused by capacitance-resistance effect and improving the quality of displayed picture.

One of the two adjacent pixel groups 01 includes the first target pixel 11, the fourth target pixel 22 and the fifth target pixel 31, and the other of the two adjacent pixel groups 01 includes the second target pixel 12, the third target pixel 21 and the sixth target pixel 32. Alternatively, one of the two adjacent pixel groups 01 includes the first target pixel 11, the third target pixel 21 and the fifth target pixel 31, and the other of the two adjacent pixel groups 01 includes the second target pixel 12, the fourth target pixel 22 and the sixth target pixel 32.

In this embodiment, the first pixel unit 10, the second pixel unit 20 and the third pixel unit 30 of a same pixel group 01 can be driven by a high voltage or a low voltage at the same time. That is to say, a pixel group 01 includes a first target pixel 11, a third target pixel 21 and a fifth target pixel 31, and its adjacent pixel group 01 includes a second target pixel 12, a fourth target pixel 22 and a sixth target pixel 32. Specifically, in one of the two adjacent pixel group 01, the first sub-pixels in the first pixel unit 10 can be driven with the first target high voltage driving data, the second sub-pixels in the second pixel unit 20 adjacent to the first pixel unit 10 can be driven with the second target high voltage driving data, and the third sub-pixels in the third pixel unit 30 adjacent to the second pixel unit 20 can be driven with the third target high voltage driving data. In the other of the two adjacent pixel group 01, the first sub-pixels in the first pixel unit 10 can be driven with the first target low voltage driving data, The second sub-pixels in the second pixel unit 20 adjacent to the first pixel unit 10 can be driven with the second target low voltage driving data, and the third sub-pixel in the third pixel unit 30 adjacent to the second pixel unit 20 can be driven with the third target low voltage driving data.

In addition, in order to reduce the graininess of the picture and improve the picture quality, the first pixel unit 10, the second pixel unit 20 and the third pixel unit 30 in a same pixel group 01 can be driven by a high voltage and a low voltage respectively. That is, the first target pixel 11, the third target pixel 21 and the fifth target pixel 31 driven by the high voltage do not exist in a same pixel group 01 at the same time, and the second target pixel, the fourth target pixel 22 and the sixth target pixel 32 driven by the low voltage do not exist in a same pixel group 01 at the same time. That is to say, a pixel group 01 includes the first target pixel 11, the fourth target pixel 22 and the fifth target pixel 31 at the same time, and its adjacent pixel group 01 includes the second target pixel 12, the third target pixel 21 and the sixth target pixel 32 at the same time. Specifically, in one of two adjacent pixel groups 01, the first sub-pixels in the first pixel unit 10 can be driven with the first target high voltage driving data, the second sub-pixels in the second pixel unit 20 adjacent to the first pixel unit 10 can be driven with the second target low voltage driving data, and the third sub-pixels in the third pixel unit 30 adjacent to the second pixel unit 20 can be driven with the third target high voltage driving data. In the other of the two adjacent pixel group 01, the first sub-pixels in the first pixel unit 10 can be driven with the first target low voltage driving data, the second sub-pixels in the second pixel unit 20 adjacent to the first pixel unit 10 can be driven with the second target high voltage driving data, and the third sub-pixels in the third pixel unit 30 adjacent to the second pixel unit 20 can be driven with the third target low voltage driving data.

In addition, one of the two adjacent pixel groups 01 may include the first target pixel 11, the fourth target pixel 22 and the sixth target pixel 32, and the other of the two adjacent pixel groups 01 may include the second target pixel 12, the third target pixel 21 and the fifth target pixel 31. Alternatively, one of the two adjacent pixel groups 01 may include the first target pixel 11, the third target pixel 21 and the sixth target pixel 32, and the other of the two adjacent pixel groups 01 may include the second target pixel 12, the fourth target pixel 22 and the fifth target pixel 31. Alternatively, one of the two adjacent pixel groups 01 may include the second target pixel 12, the third target pixel 21 and the fifth target pixel 31, and the other of the two adjacent pixel groups 01 may include the first target pixel 11, the fourth target pixel 22 and the sixth target pixel 32.

Furthermore, in order to prevent the sub-pixels from being driven with the high voltage or the low voltage for a long time, and the naked eyes can easily find the defects of bright sub-pixels and dark sub-pixels in the picture, when displaying an image frame, the target high voltage driving data and the target low voltage driving data corresponding to a same sub-pixel can be determined according to the methods in the above embodiments, and the target high voltage driving data and the target low voltage driving data are input to the corresponding sub-pixel in time sequence. Specifically, defining that the sub-pixels driven with high voltage driving data includes the first target pixel 11, the third target pixel 21 and the fifth target pixel 31, and the sub-pixels driven with low voltage driving data includes the second target pixel 12, the fourth target pixel 22 and the sixth target pixel 32, before the steps of driving the first target pixel 11 with the first target high voltage driving data, driving the second target pixel with the first target low voltage driving data, and driving the third target pixel 21 with the second target high voltage driving data, driving the fourth target pixel 22 with the second target low voltage driving data, driving the fifth target pixel 31 with the third target high voltage driving data, and driving the sixth target pixel 32 with the third target low voltage driving data, the method further includes:

Step S01, respectively determining corresponding fourth low voltage data according to the initial driving data corresponding to each of the sub-pixels driven with the high voltage driving data; and respectively determining corresponding fourth high voltage data according to the initial driving data corresponding to each of the sub-pixels driven by the low voltage driving data.

Determining the fourth low voltage data corresponding to the first target pixel 11 according to the first initial driving data; determining the fourth low voltage data corresponding to the third target pixel 21 according to the third initial driving data; and determining the fourth low voltage data corresponding to the fifth target pixel 31 according to the fifth initial driving data, the determination of the fourth low voltage data corresponding to each of the sub-pixels driven by the high voltage driving data can refer to the above-mentioned determination of the first low voltage data and the first compensation low voltage data, and will not be described here.

Determining the fourth high voltage data corresponding to the second target pixel 12 according to the second initial driving data; determining the fourth high voltage data corresponding to the fourth target pixel 22 according to the fourth initial driving data; and determining the fourth high voltage data corresponding to the sixth target pixel 32 according to the sixth initial driving data, the determination of the fourth high voltage data corresponding to each of the sub-pixels driven by the low voltage driving data can refer to the above-mentioned determination of the first high voltage data and the first compensation high voltage data, and will not be described here.

Step S02, determining fourth target low voltage driving data corresponding to each of the sub-pixels driven with the high voltage driving data according to the fourth low voltage data; and determining fourth target high voltage driving data corresponding to each of the sub-pixels driven with the low voltage driving data according to the fourth high voltage data.

The determination of the fourth target low voltage driving data can refer to the above-mentioned determination of the first target low voltage driving data, and will not be described here. The determination of the fourth target high voltage driving data can refer to the above-mentioned determination of the first target high voltage driving data, and will not be described here.

After the steps of driving the first target pixel 11 with the first target high voltage driving data, driving the second target pixel 12 with the first target low voltage driving data, and driving the third target pixel 21 with the second target high voltage driving data, driving the fourth target pixel 22 with the second target low voltage driving data, driving the fifth target pixel 31 with the third target high voltage driving data, and driving the sixth target pixel 32 with the third target low voltage driving data, the method further includes:

Step S03, driving the sub-pixels originally driven with the high voltage driving data with corresponding fourth target low voltage driving data, and driving the sub-pixels originally driven with the low voltage driving data with corresponding fourth target high voltage driving data.

Taking the first target pixel 11 as an example, after the first target pixel 11 is driven with the first target high voltage driving data for a preset time, the fourth target low voltage driving data is used to drive the first target pixel 11. The fourth target low voltage driving data here is determined according to the first low voltage data of the first target pixel 11, specifically, the fourth target low voltage driving data can be determined according to the first low voltage data of the first target pixel 11 and the first compensation low voltage data of the first compensation pixel corresponding to the first target pixel 11. In addition, the determination of the fourth target low voltage driving data corresponding to the third target pixel 21 and the fifth target pixel 31 can refer to the first target pixel 11 and will not be described here.

Taking the second target pixel 12 as an example, after the second target pixel 12 is driven with the first target low voltage driving data for the preset time, the fourth target high voltage driving data is used to drive the second target pixel 12. The fourth target high voltage driving data here is determined according to the first high voltage data of the second target pixel 12, specifically, the fourth target high voltage driving data is determined according to the first high voltage data of the second target pixel 12 and the first high voltage data of the second compensation pixel corresponding to the second target pixel 12. In addition, the determination of the fourth target high voltage driving data corresponding to the fourth target pixel 22 and the sixth target pixel 32 can refer to the second target pixel 12 and will not be described here.

The preset time can be set according to actual display requirements.

In addition, the embodiments of the present application also provides a driving device for display panel, the driving device for display panel includes:

a data input module configured to acquire first initial driving data corresponding to the first target pixel and second initial driving data corresponding to the second target pixel;

a data conversion module configured to determine corresponding first high voltage data according to the first initial driving data and corresponding first low voltage data according to the second initial driving data;

a processing module configured to determine first target high voltage driving data corresponding to the first target pixel 11 according to the first high voltage data, and first target low voltage driving data corresponding to the second target pixel 12 according to the first low voltage data; and a driving module configured to drive the first target pixel 11 with the first target high voltage driving data and drive the second target pixel 12 with the first target low voltage driving data.

The driving device for display panel in the embodiments of the present application includes all the technical features of the driving methods for display panel in the above embodiments, and therefore has same technical effects as the driving methods in the above embodiments, and will not be described here.

Figure 7:
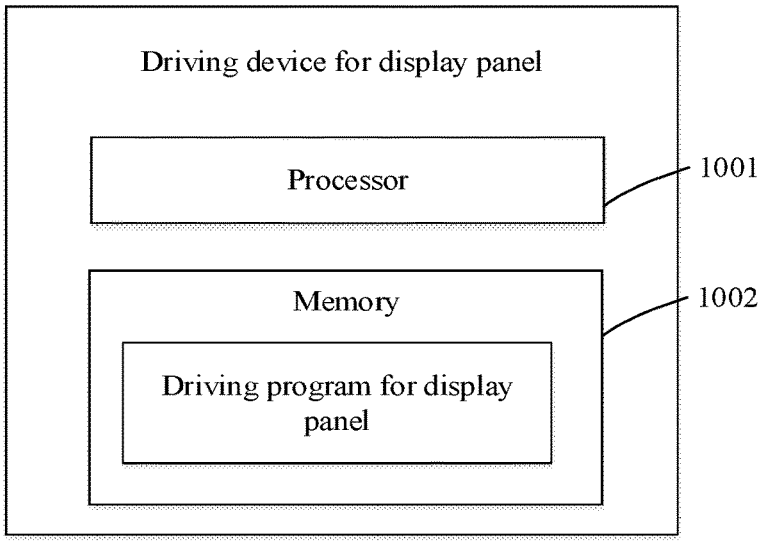
FIG. 7 is a schematic structural diagram of a driving device for display panel in a hardware operating environment of the present application.

In addition, the embodiments of the present application also provide a driving device for display panel, which is mainly used for driving a display panel, especially a liquid crystal display panel. As shown in FIG. 7, the driving device for display panel includes a processor 1001, such as a CPU, and a memory 1002. The above processor 1001 is communicated and connected to the memory 1002. The memory 1002 can be a high-speed RAM memory or a stable memory (non-volatile memory), such as disk memory. The memory 1002 may optionally be a storage device independent of the aforementioned processor 1001. It should be understood by those skilled in the art that the structure shown in FIG. 7 does not constitute a limitation on the device and the device may include more or less components than illustrated, or a combination of certain components, or different arrangement of components. As a computer readable storage medium, the memory 1002 can store a driving program for display panel. In the device shown in FIG. 7, the processor 1001 can be used to call the driving program for display panel stored in the memory 1002 and perform relevant operations of the above-mentioned driving methods for display panel.

In addition, the present application also provides a display which includes a display panel and a driving device for display panel in the above-described embodiments. The display panel is communicated with the driving device for display panel.

In addition, the present application also provides a readable storage medium in which a driving program for display panel is stored, and the operations of the driving method for display panel described in the above embodiments is implemented when the driving program for display panel is executed by a processor.

What is claimed is:

1. A driving method for display panel, wherein the display panel comprises a plurality of pixel groups arranged in an array, each of the pixel groups comprising a first pixel unit, and the first pixel unit comprising at least two first sub-pixels; a first sub-pixel in one of any two adjacent pixel groups is defined as a first target pixel and a first sub-pixel in the other of the two adjacent pixel groups is defined as a second target pixel; the driving method for display panel comprises the following steps:

acquiring first initial driving data corresponding to the first target pixel, acquiring second initial driving data corresponding to the second target pixel;

determining corresponding first high voltage data according to the first initial driving data, and determining corresponding first low voltage data according to the second initial driving data;

determining first target high voltage driving data corresponding to the first target pixel according to the first high voltage data, and determining first target low voltage driving data corresponding to the second target pixel according to the first low voltage data; and driving the first target pixel with the first target high voltage driving data, and driving the second target pixel with the first target low voltage driving data wherein defining second target pixels adjacent to the first target pixel as first compensation pixels, the step of determining first target high voltage driving data corresponding to the first target pixel according to the first high voltage data comprises:

determining the first compensation pixels corresponding to the first target pixel;

determining corresponding first compensation high voltage data according to second initial driving data of the first compensation pixels; and determining the first target high voltage driving data according to the first high voltage data and the first compensation high voltage data.

2. The driving method of claim 1, wherein the step of determining corresponding first high voltage data according to the first initial driving data, and determining corresponding first low voltage data according to the second initial driving data comprises:

increasing the first initial driving data with a first preset amplitude to obtain the first high voltage data, and decreasing the second initial driving data with a second preset amplitude to obtain the first low voltage data.

3. The driving method of claim 1, further comprising:

determining the first preset amplitude according to a gray scale of the first target pixel, and determining the second preset amplitude according to a gray scale of the second target pixel.

4. The driving method of claim 1, wherein the step of determining corresponding first compensation high voltage data according to second initial driving data of the first compensation pixels comprises:

increasing the second initial driving data of the first compensation pixels with a third preset amplitude to obtain the first compensation high voltage data; wherein the third preset amplitude is a preset voltage increased corresponding to the first compensation pixels.

5. The driving method of claim 1, wherein the step of determining the first target high voltage driving data according to the first high voltage data and the first compensation high voltage data comprises:

acquiring a first preset weight corresponding to the first compensation pixels; and determining the first target high voltage driving data according to the first high voltage data, the first compensation high voltage data, and the first preset weight.

6. The driving method of claim 5, wherein the step of acquiring a first preset weight corresponding to the first compensation pixels comprises:

acquiring a resolution of a current picture; and determining a first preset weight corresponding to the first compensation pixels according to the acquired resolution.

7. The driving method of claim 1, wherein defining first target pixels adjacent to the second target pixel as second compensation pixels, the step of determining first target low voltage driving data corresponding to the second target pixel according to the first low voltage data comprises:

determining the second compensation pixels corresponding to the second target pixel;

determining corresponding first compensation low voltage data according to first initial driving data of the second compensation pixels; and determining the first target low voltage driving data according to the first low voltage data and the first compensation low voltage data.

8. The driving method of claim 7, wherein the step of determining corresponding first compensation low voltage data according to first initial driving data of the second compensation pixels comprises:

decreasing the first initial driving data of the second compensation pixels with a fourth preset amplitude to obtain the first compensation low voltage data; wherein the fourth preset amplitude is a preset voltage decreased corresponding to the second compensation pixels.

9. The driving method of claim 7, wherein the step of determining the first target low voltage driving data according to the first low voltage data and the first compensation low voltage data comprises:

acquiring a second preset weight corresponding to the second compensation pixels; and determining the first target low voltage driving data according to the first low voltage data, the first compensation low voltage data, and the second preset weight.

10. The driving method of claim 9, wherein the step of acquiring a second preset weight corresponding to the second compensation pixels comprises:

acquiring a resolution of a current picture; and determining a second preset weight corresponding to the second compensation pixels according to the acquired resolution.

11. The driving method of claim 1, wherein each of the pixel groups further comprises a second pixel unit and a third pixel unit, the second pixel unit comprising at least two second sub-pixels, the third pixel unit comprising at least two third sub-pixels, the first pixel unit, the second pixel unit, and the third pixel unit in each of the pixel groups being sequentially arranged in a row direction;

defining a second sub-pixel in one of any two adjacent pixel groups as a third target pixel and defining a second sub-pixel in the other of the two adjacent pixel groups as a fourth target pixel; defining a third sub-pixel in one of any two adjacent pixel groups as a fifth target pixel and defining a third sub-pixel in the other of the two adjacent pixel groups as a sixth target pixel;

the driving method for display panel further comprises the following steps:

acquiring third initial driving data corresponding to the third target pixel, acquiring fourth initial driving data corresponding to the fourth target pixel, acquiring fifth initial driving data corresponding to the fifth target pixel, acquiring sixth initial driving data corresponding to the sixth target pixel;

determining corresponding second high voltage data according to the third initial driving data, determining corresponding second low voltage data according to the fourth initial driving data, determining corresponding third high voltage data according to the fifth initial driving data, and determining corresponding third low voltage data according to the sixth initial driving data;

determining second target high voltage driving data corresponding to the third target pixel according to the second high voltage data, determining second target low voltage driving data corresponding to the fourth target pixel according to the second low voltage data, determining third target high voltage driving data corresponding to the fifth target pixel according to the third high voltage data, and determining third target low voltage driving data corresponding to the sixth target pixel according to the third low voltage data; and driving the third target pixel with the second target high voltage driving data, driving the fourth target pixel with the second target low voltage driving data, driving the fifth target pixel with the third target high voltage driving data, and driving the sixth target pixel with the third target low voltage driving data.

12. The driving method of claim 11, wherein one of two adjacent pixel groups comprises the first target pixel, the fourth target pixel, and the fifth target pixel, and the other of the two adjacent pixel groups comprises the second target pixel, the third target pixel, and the sixth target pixel.

13. The driving method of claim 12, wherein sub-pixels that are defined to be driven with high voltage driving data comprise the first target pixel, the third target pixel, and the fifth target pixel, and sub-pixels that are defined to be driven with low voltage driving data comprise the second target pixel, the fourth target pixel, and the sixth target pixel; wherein before the steps of driving the first target pixel with the first target high voltage driving data, driving the second target pixel with the first target low voltage driving data, driving the third target pixel with the second target high voltage driving data, driving the fourth target pixel with the second target low voltage driving data, driving the fifth target pixel with the third target high voltage driving data, and driving the sixth target pixel with the third target low voltage driving data, the driving method further comprises:

respectively determining corresponding fourth low voltage data according to initial driving data corresponding to each of the sub-pixels driven with the high voltage driving data; and respectively determining corresponding fourth high voltage data according to the initial driving data corresponding to each of the sub-pixels driven by the low voltage driving data;

determining fourth target low voltage driving data corresponding to each of the sub-pixels driven with the high voltage driving data according to the fourth low voltage data; and determining fourth target high voltage driving data corresponding to each of the sub-pixels driven with the low voltage driving data according to the fourth high voltage data;

wherein after the steps driving the first target pixel with the first target high voltage driving data, driving the second target pixel with the first target low voltage driving data, driving the third target pixel with the second target high voltage driving data, driving the fourth target pixel with the second target low voltage driving data, driving the fifth target pixel with the third target high voltage driving data, and driving the sixth target pixel with the third target low voltage driving data, the driving method further comprises:

driving the sub-pixels originally driven with the high voltage driving data with corresponding fourth target low voltage driving data, and driving the sub-pixels originally driven with the low voltage driving data with corresponding fourth target high voltage driving data.

14. The driving method of claim 11, wherein one of two adjacent pixel groups comprises the first target pixel, the third target pixel, and the fifth target pixel, and the other of the two adjacent pixel groups comprises the second target pixel, the fourth target pixel, and the sixth target pixel.

15. A driving device for display panel, wherein the driving device comprises a memory, a processor and a driving program for display panel stored in the memory and executable by the processor, when the driving program for display panel is executed by the processor, the following steps of a driving method for display panel are realized:

acquiring first initial driving data corresponding to a first target pixel, acquiring second initial driving data corresponding to a second target pixel;

determining corresponding first high voltage data according to the first initial driving data, and determining corresponding first low voltage data according to the second initial driving data;

determining first target high voltage driving data corresponding to the first target pixel according to the first high voltage data, and determining first target low voltage driving data corresponding to the second target pixel according to the first low voltage data; and driving the first target pixel with the first target high voltage driving data, and driving the second target pixel with the first target low voltage driving data;

wherein defining second target pixels adjacent to the first target pixel as first compensation pixels, the step of determining first target high voltage driving data corresponding to the first target pixel according to the first high voltage data comprises:

determining the first compensation pixels corresponding to the first target pixel;

determining corresponding first compensation high voltage data according to second initial driving data of the first compensation pixels; and determining the first target high voltage driving data according to the first high voltage data and the first compensation high voltage data.

16. A display comprising:

a display panel; and a driving device for display panel connected with the display panel, the driving device for display panel comprising a memory, a processor and a driving program for display panel stored in the memory and executable by the processor, wherein when the driving program for display panel is executed by the processor, the following steps of a driving method for display panel are realized:

acquiring first initial driving data corresponding to a first target pixel, acquiring second initial driving data corresponding to a second target pixel;

determining corresponding first high voltage data according to the first initial driving data, and determining corresponding first low voltage data according to the second initial driving data;

determining first target high voltage driving data corresponding to the first target pixel according to the first high voltage data, and determining first target low voltage driving data corresponding to the second target pixel according to the first low voltage data; and driving the first target pixel with the first target high voltage driving data, and driving the second target pixel with the first target low voltage driving data;

wherein defining second target pixels adjacent to the first target pixel as first compensation pixels, the step of determining first target high voltage driving data corresponding to the first target pixel according to the first high voltage data comprises:

determining the first compensation pixels corresponding to the first target pixel;

determining corresponding first compensation high voltage data according to second initial driving data of the first compensation pixels; and determining the first target high voltage driving data according to the first high voltage data and the first compensation high voltage data.

* * * * *